US005873570A

United States Patent [19]

Jones

[11] Patent Number: 5,873,570

[45] Date of Patent: Feb. 23, 1999

[54] TOWEL GAMES

[76] Inventor: Sandra K. Jones, Dunmore Town P.O., Harbour Island, Eleuthera, Bahamas

[21] Appl. No.: 964,487

[22] Filed: Nov. 5, 1997

[51] Int. Cl.[6] ..... A63F 3/00

[52] U.S. Cl. ..... 273/286; 273/288

[58] Field of Search ..... 273/236, 248, 273/249, 285, 286, 288

[56] References Cited

U.S. PATENT DOCUMENTS

| | | | |
|---|---|---|---|
| 1,708,318 | 4/1929 | Little | 273/286 X |
| 2,667,353 | 1/1954 | Lanice | 273/286 |
| 4,291,884 | 9/1981 | Bass et al. | 273/288 X |
| 4,673,184 | 6/1987 | Sansores | 273/286 |
| 4,961,583 | 10/1990 | Koch et al. | 273/288 X |
| 5,240,255 | 8/1993 | Barlow | 273/288 X |

*Primary Examiner*—William E. Stoll
*Attorney, Agent, or Firm*—Howard & Howard

[57] ABSTRACT

A game includes a playing surface that is made from a fabric material such as a beach towel. The playing surface includes reinforcing members near the edges that receive retaining members to maintain the playing surface in desired position and location regardless of the base surface. The playing surface is adapted to be placed on a beach, carpeting or grass, for example. A plurality of playing pieces preferably are generally hollow shells that have an exterior surface in the shape of a desired object. The interior of the shell preferably is a negative of the exterior. The interior portion of the shell is generally hollow and can receive a moldable material such as sand to create a cast of the playing piece that can be used as a score marker. A die that is included in the game is over-sized and has generously rounded corners and edges so that the die more easily rolls along a variety of indoor or outdoor surfaces.

17 Claims, 1 Drawing Sheet

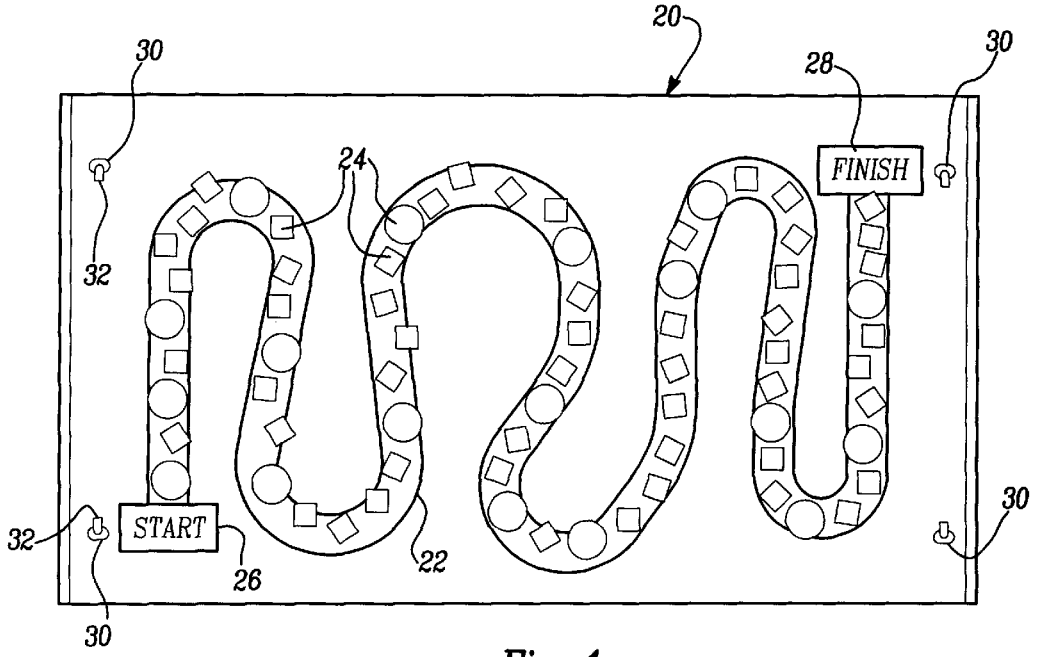
Fig-1
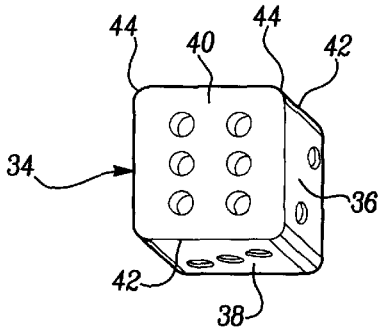
Fig-2
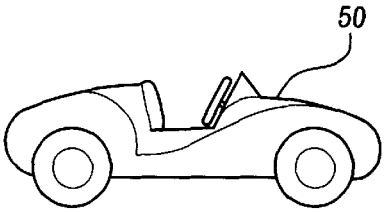
Fig-3
Fig-4
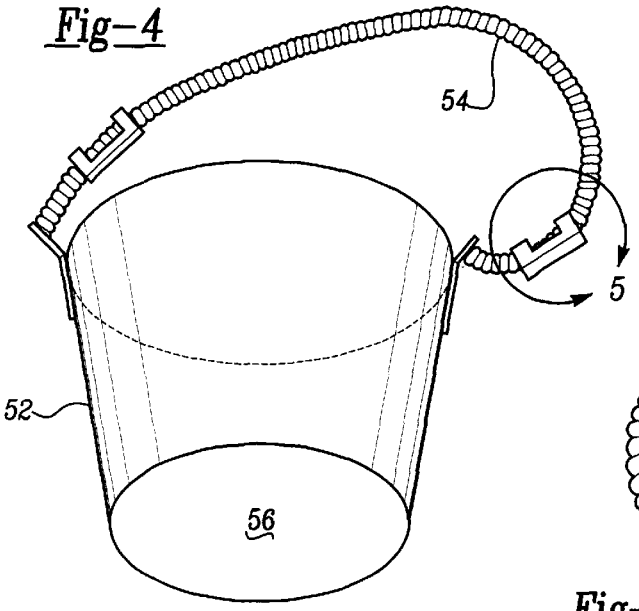
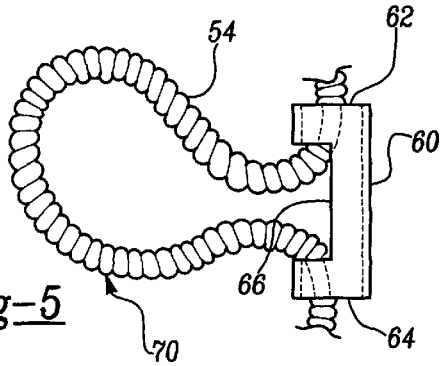
Fig-5

TOWEL GAMES

BACKGROUND OF THE INVENTION

This invention generally relates to a game where the playing surface is depicted on a beach towel.

A variety of board games are available that provide amusement to adults and children. One shortcoming of these games is that they typically require a level hard playing surface such as a table or floor within a building. Further, these games are limited in that they are usually only convenient to be played indoors. Further, the playing pieces and cards that are associated with many games make it impractical to attempt to play the game outdoors. Further, most games come in a cardboard container which, if exposed to the elements, would likely quickly deteriorate making it difficult to maintain the various pieces of the game together.

Therefore, there is a need for a game that is available to be played outdoors yet provide the same type of enjoyment available with most indoor board games.

SUMMARY OF THE INVENTION

In general terms this invention is a game that can be played outdoors while providing the same type of excitement and enjoyment of a board game. The game of this invention includes several basic parts. A playing surface is made from a fabric material and adapted to be arranged on a variety of base surfaces. The playing surface preferably includes a pathway having a beginning space, a finishing space and a plurality of spaces along the pathway between the beginning and finishing spaces. A plurality of playing pieces are provided so that each player can move along the spaces on the pathway. A die has a plurality of faces each marked to indicate movement along the pathway. The die preferably is oversized and has generally rounded edges so that the die can be rolled along the playing surface and any one of the variety of base surfaces.

In the most preferred embodiment, the playing surface is a beach towel having reinforcing members near the edges of the towel that can be staked into the ground to maintain the playing surface in place. The playing pieces are preferably hollow molds that can be used to make sand markers (when the game is played on a beach) to indicate a score in the game.

The various features of this invention will become more clear from the detailed description of the currently preferred embodiment. The drawings that accompany the detailed description can be briefly described as follows.

BRIEF DESCRIPTION OF THE DRAWINGS

FIG. 1 is a diagrammatic illustration of a playing surface designed according to this invention.

FIG. 2 is a perspective illustration of a die designed to be used with the playing surface of FIG. 1.

FIG. 3 is a side elevational view of a playing piece for use in the game of this invention.

FIG. 4 is a perspective illustration of a container for keeping and carrying the various portions of the game.

FIG. 5 is a detailed illustration of the portion of FIG. 4 indicated in the circle "5."

DETAILED DESCRIPTION OF THE PREFERRED EMBODIMENT

FIG. 1 illustrates a playing surface 20 that is made from a fabric material and adapted to be arranged on a variety of base surfaces including, for example, a beach, a lawn or essentially any other base surface. The playing surface 20 preferably is a beach towel. In the illustrated embodiment, a pathway 22 is printed onto the beach towel through a conventional fabric painting or dying process. The pathway 22 includes a plurality of spaces 24 that extend along the pathway between a beginning space 26 and a finishing space 28.

The spaces 24 preferably have different geometric shapes or other visual indicia such as coloring for purposes to be described below.

The beach towel playing surface 20 preferably includes a plurality of reinforcing members 30 near the edges of the beach towel. The reinforcing members 30 preferably are grommets fastened to the beach towel in a conventional manner, which provide an opening through the center of the grommet. A retaining member 32 can be inserted through the center of the reinforcing members 30 to maintain the playing surface 20 in a selected orientation on a selected base surface. In the preferred embodiment, the retaining members comprise spikes that are inserted into a ground surface through the center hole of the grommet reinforcing members. Conventional tent spikes may be used. This provides the advantage of maintaining the playing surface in place despite windy conditions outdoors.

FIG. 2 illustrates a die 34 that is configured to be useable with the playing surface 20. The illustrated die 34 includes six faces, three of which are illustrated at 36, 38 and 40, respectively. The edges 42 between adjacent faces preferably are generally rounded. The corners 44 of the die also are rounded to enable the die to more easily roll along the fabric playing surface 20 or an adjacent base surface, which may be a sandy beach for example. The die preferably is oversized and most preferably at least a cube having two inch sides so that it can easily roll on sand, carpeting, grass or any other surface upon which the playing surface 20 is placed.

FIG. 3 illustrates an example playing piece 50 that is used to mark a player's position along the pathway 22 on the playing surface 20. In the illustrated embodiment, the playing piece is a race car and the pathway 22 is a race track on the beach towel. In the preferred embodiment, each player has their own playing piece to move along the pathway while playing the game.

Importantly, each playing piece preferably includes a generally hollow shell having an exterior surface shaped to look like the desired playing piece. The interior of the shell preferably is a negative of the exterior so that the playing piece can be filled with a moldable material, such as sand, to form a score marker than can be positioned near the playing surface 20 to keep score of the game. While a race car playing piece 50 is illustrated in FIG. 3 other shaped pieces such as boats, scuba divers, fish, dinosaurs, characters, etc. can be used.

Not only a variety of playing pieces 50 could be used but a variety of designs for the playing surface 20 can be used to accommodate the different playing pieces. Further, by using different playing pieces and a different pathway 22, the nature of the game is varied.

The illustrated embodiment preferably is played in the following general manner. First, the players arrange the playing surface 20 on an appropriate base surface. If the game is being played outdoors the retaining members 32 can be placed through the reinforcing members 30 to maintain the playing surface 20 in a desired position and location. Each player chooses a playing piece 50. The playing pieces 50 preferably are different colors or different shapes so they are distinguishable from one another. Each player takes a turn rolling the die 34 and the player with the highest score proceeds first. A laminated instruction card (not illustrated) preferably is included that provides instructions to the players as to a particular action to be taken upon landing on a particular space 24 along the pathway 22. Each player takes a turn by rolling the die 34 and moving their playing piece 50 an appropriate number of spaces along the pathway 22.

In one embodiment, the laminated instruction card provides the following instructions to the players. When a player lands a blue colored circular space, they must return to the starting position 26 because that indicates mechanical problems with their car. A pink colored square space indicates that the player is stuck in sand and cannot move forward along the pathway 22 until they roll a 3 with the die 34. An orange colored square space indicates that the player has a flat tire and loses one turn. A green colored square space indicates a detour and the player must move back three spaces. A blue colored square indicates that the player has had a spin out and must move backward one space. A red colored square indicates a downhill run and the player is permitted to move ahead four spaces. At least one of the spaces is a black colored circle that is a bonus spot that allows the player to exchange places with the leader of the game. The above indications are just examples of the type of rules that can be used to play the game of the illustrated embodiment. Once a player successfully moves to the finishing space 28, they have won one game. At that point, the player can use their playing piece 50 to make a sand mold in the sand near the playing surface 20 to indicate that they have won one game.

Other embodiments include colored geometric spaces 24 along the pathway 22. The die 34 is modified from that illustrated in FIG. 2 to include either a color or a geometric space or a combination of both on each face of the die. When a player casts the die 34 the player moves to the next available space that corresponds to the upwardly facing face of the die 34. Such an embodiment can be particularly useful for young children who are learning colors or shapes and cannot read an instruction card that may be included with more sophisticated embodiments of the game.

Since the game of this invention is ideally suited for use outdoors, it includes an advantageously designed carrying case illustrated in FIG. 4. A plastic container 52, which preferably is in the shape of a pail, is useful for carrying about the die 34 and the various playing pieces 50 of the game. Other items can be included and carried within the container 52 such as a sand shovel and the laminated instruction card, which gives instructions for playing the game. A carrying strap 54 preferably is made from a synthetic or natural material and shaped in the form of a cord. The preferred embodiment also includes a clear plastic bottom 56 on the pail 52 that can be useful for seeing through the bottom of the pail while playing in the water at a beach, for example. A lid (not illustrated) preferably is also included to cover over the opening in the pail 52. The lid most preferably is usable as a "frisbee".

As best seen in FIG. 5, the container preferably includes a pair of cinching members 60 along the carrying strap 54. The cinching members 60 preferably are generally cylindrical in shape having a longitudinal opening between a first end 62 and a second end 64. The carrier cord 54 is received through the longitudinal opening the center of the cinching member 60. A side opening 66 preferably is cut through the generally cylindrical wall of the generally tubular cinching member 60 so that a portion of the carrying strap 54 can be pulled through the side opening 66. By manipulating the carrying strap 54 into a loop 70, a portion of the playing surface, which has been folded or rolled up, is placed within the loop 70. The carrying strap 54 is then pulled tight about the portion of the playing surface 20 so that the beach towel is held within the loop 70. This makes the storage and transportation of the playing surface 20 convenient and readily keeps all of the components of the game together for later use.

As can been seen from the above description, this invention provides a game that is useful for playing outdoors while providing the type of excitement or enjoyment that has otherwise been available through board games that are generally limited to use indoors or only on specific surfaces. This game is readily adaptable to be used in almost any environment and can take a number of different configurations to suit a number of different age groups or interests.

The above description is exemplary rather than limiting in nature. Variations and modifications may become apparent that do not necessarily depart from the purview and spirit and of this invention. The legal scope of the protection given to this invention is limited only by the following claims.

I claim:

1. A game, comprising:

a playing surface made from a fabric material adapted to be arranged on a variety of base surfaces and including a pathway having a beginning space and a finishing space with a plurality of spaces along said pathway between said beginning and finishing spaces;

a plurality of playing pieces each used by a player to move among said spaces along said pathway, each said playing piece comprising a generally hollow mold having an outer surface shaped in a preselected form and an interior surface that is essentially a negative of said outer surface such that each said playing piece is fillable with a moldable substance to form a marker from said substance and wherein said marker is a score indicator; and a die having a plurality of faces each being marked to indicate movement along said pathway and wherein adjoining edges on said faces are generally rounded so that said die is able to be rolled along said playing surface and anyone of said variety of base surfaces.

2. The game of claim 1, wherein said playing surface comprises a beach towel.

3. The game of claim 2, wherein said towel includes a plurality of reinforcing members near edges of said towel and said game further includes a plurality of retaining members that interact with said reinforcing members to maintain said towel in a selected arrangement on a base surface.

4. The game of claim 3, wherein said reinforcing members are grommets placed near corners on said towel and said retaining members comprise spike members that have a portion that is inserted through said grommets and into said base surface.

5. The game of claim 2, further comprising a container adapted to contain said die and said playing pieces and having a generally flexible handle member and a cinching member disposed about said handle member so that a portion of said handle member can be wrapped about at least a portion of said playing surface and said handle and cinching member operate to secure said playing surface to said handle to thereby facilitate carrying said game between selected locations.

6. The game of claim 5, wherein said handle member comprises a cord and said cinching member comprises a generally cylindrical member having a rounded sidewall extending between two open ends and a side opening through said sidewall through which a portion of said cord can be manipulated to be wrapped about said playing surface.

7. The game of claim 1, wherein said playing surface comprises a beach towel and said base surface comprises a beach and said moldable substance comprises sand.

8. The game of claim 1, wherein said spaces along said pathway are visually coded and each code indicates a specific action to be taken by a player whose playing piece is placed on each said space.

9. The game of claim 8, wherein said spaces along said pathway are coded using a plurality of geometric shapes and wherein said shapes correspond to a specific action to be taken by a player whose playing piece is placed on each said space.

10. The game of claim 8, wherein said spaces are color coded and said colors correspond to a specific action to be taken by a player whose playing piece is placed on each said space.

11. The game of claim 8, wherein said die faces include indicia corresponding to said visually coded spaces to indicate movement along said pathway upon a roll of said die.

12. A game comprising:

a beach towel including a depiction of a playing surface that includes a plurality of spaces among which a player moves while playing the game;

a plurality of playing pieces used by players of the game to indicate respective positions among said spaces on said playing surface, said playing pieces each comprising a generally hollow mold having an exterior surface and an interior surface that is essentially a negative of said exterior surface, each said playing piece being fillable with sand to make a sand mold of said playing piece to be placed near said beach towel and wherein each sand mold comprises a score marker.

13. The game of claim 12, further comprising a die having a plurality of faces each being marked to indicate movement along said playing surface and wherein adjoining edges on said faces are generally rounded so that said die is able to be rolled along said beach towel and adjacent surfaces.

14. The game of claim 13, wherein said playing surface includes a plurality of spaces along a pathway and a player places a selected playing piece onto one of said spaces and moves along said pathway based upon casting said die and wherein said spaces are coded to indicate an action to be taken by a player whose playing piece is on each said space.

15. The game of claim 14, further comprising a laminated instruction sheet indicating what action is to be taken by a player whose playing piece is on each said space.

16. The game of claim 12, wherein said beach towel includes a plurality of grommets spaced about said towel and further comprising a corresponding number of securing members that each have a portion that is adapted to be inserted through one of said grommets and into a ground surface beneath said beach towel.

17. A method of playing a game having a playing surface with a plurality of spaces depicted on a beach towel and a plurality of playing pieces that each are a generally hollow mold having a selected exterior surface and an interior surface that corresponds to the exterior surface, comprising the steps of:

(A) arranging the beach towel on a selected surface;

(B) assigning at least one playing piece to each player;

(C) each player placing their playing piece on a beginning space;

(D) moving the respective playing pieces among the spaces based upon rolling a die on said beach towel;

(E) taking action based upon instructions associated with a space that a playing piece is placed upon;

(F) repeatedly performing steps (D) and (E) until at least one player moves their playing piece onto a finishing space;

(G) filling the playing piece of the player that is first to reach the finishing space with sand to make a sand mold of the playing piece; and (H) placing the sand mold near the beach towel to thereby indicate a score of the game.

* * * * *